United States Patent [19]

Logan

[11] Patent Number: 4,827,695

[45] Date of Patent: May 9, 1989

[54] APPARATUS FOR HEAT SEALING A CANDY WRAPPER TO A SUCKER STICK

[76] Inventor: Kenneth W. Logan, Rt. 2, Box 500A, Comanche, Okla. 73529

[21] Appl. No.: 158,451

[22] Filed: Feb. 22, 1988

[51] Int. Cl.[4] ..... B65B 7/12; B65B 51/10

[52] U.S. Cl. ..... 53/370; 53/379; 156/475; 156/499; 156/583.1; 219/229

[58] Field of Search ..... 156/583.1, 149, 475, 156/486, 499, 579; 219/229, 241; 53/483, 217, 227, 370, 379

[56] References Cited

U.S. PATENT DOCUMENTS

| | | | |
|---|---|---|---|
| 2,656,657 | 10/1953 | Bartle | 53/217 |
| 3,889,096 | 6/1975 | Asselman et al. | 219/229 |
| 4,208,571 | 6/1980 | Moumaneix et al. | 156/579 |
| 4,285,753 | 8/1981 | Warthen | 156/579 |
| 4,734,559 | 3/1988 | Fortune et al. | 219/241 |

*Primary Examiner*—Michael Wityshyn
*Attorney, Agent, or Firm*—Robert K. Rhea

[57] ABSTRACT

The open end of a flexible material container surrounding the sucker stick on a sucker is sealed therewith in a wrap-around action by manual angular rotation of the sucker and its stick when the latter is temporarily maintained in contact with the heated surface of the walls forming a U-shaped recess in a candy wrapper heat sealing head.

1 Claim, 1 Drawing Sheet

APPARATUS FOR HEAT SEALING A CANDY WRAPPER TO A SUCKER STICK

BACKGROUND OF THE INVENTION

1. Field of the Invention

This invention relates to package seals and more particularly to apparatus for heat sealing the open end of a cellophane candy wrapper twisted around the periphery of a sucker stick.

It is common practice for cleanliness and health reasons to package hard candy, commonly known as suckers, on an elongated rod or handle, commonly called a sucker stick. The stick is formed of any suitable material which may be wood or a cylinder rolled from cellulose.

Candy suckers are a popular confectionery, particularly with children, and by mass production, most candy suckers are encapsulated in their entirety by their containers. However, novelty candy sucker items, particularly those formed from hard candy, having considerably more mass than the standard relatively small spherical or disk-shaped sucker as well as a decorative appearance sometimes depicting an unusual shape require that each individual sucker stick equipped sucker be individually packaged in a flexible wall preferably transparent container. The open or mouth end of each container must then be sealed, preferably in a wrapa-round-around or twisted action, with that portion of the sucker stick projecting beyond the candy on one end thereof. Of a necessity such candy wrappers are usually of greater wall thickness than the candy wrapper of suckers constructed and packaged by mass production methods.

This invention provides an apparatus which accomodates the individual wrapping of novelty item suckers.

2. Description of the Prior Art

The prior art generally discloses apparatus such as angularly rotating mandrels for twisting the open or mouth ends of flexible containers, such as bread wrappers. The twisted end of each such container receives a suitable clip or fastener to maintain the wrapper closed.

The apparatus of this invention is distinctive over such patents by heat sealing the candy wrapper open or mouth end to the periphery of the sucker stick in spaced-apart relation relative to the candy mounted on one end portion of the stick.

SUMMARY OF THE INVENTION

A generally rectangular head is supported in upstanding relation by a base. The head is characterized by a transverse dimension less than the length of the end portion of a sucker stick projecting beyond a sucker on one end of the stick. The head is provided with a transverse generally U-shaped open slot or recess having a bight portion formed on a radius complemental with the radius of a sucker stick. The head is internally heated by electrical resistance heating element operated by base contained controls connecting a source of electrical energy with the heating element. The open end of a sucker containing candy wrapper is twisted about the periphery of the sucker stick and manually inserted laterally into the U-shaped recess of the head and manually twisted, usually one complete revolution, about the axis of the sucker stick which heat seals the wrapper by contact with the walls forming the recess, to the periphery of the sucker stick.

The principal object is to provide an apparatus for heat sealing the walls of a candy wrapper to the periphery of a sucker stick.

DESCRIPTION OF THE PREFERRED EMBODIMENTS

Figures 1, 2, 3, 4, 5:
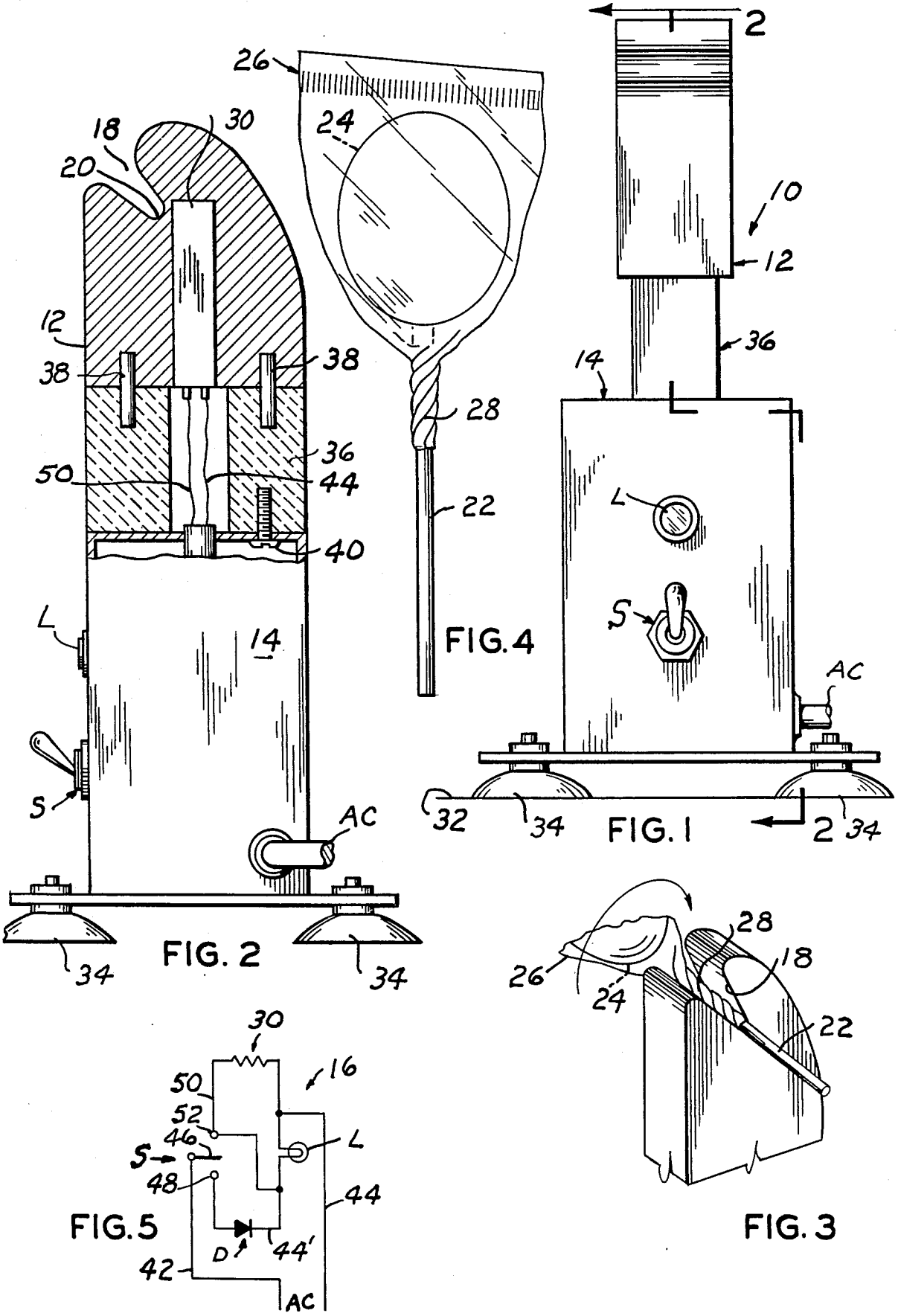
FIG. 1 is a front elevational view of the apparatus.
FIG. 2 is a vertical cross sectional view, partially in-elevation, taken substantially along the line 2—2 of FIG. 1.
FIG. 3 is a fragmentary perspective view of the head of the apparatus illustrating the manner of sealing a candy wrapper to a sucker stick.
FIG. 4 is a plan view of a sucker contained by a candy wrapper which has been heat sealed to the sucker stick; and, FIG. 5 is a wiring diagram.

Like characters of reference designate like parts in those figures of the drawings in which they occur.

In the drawings:

The reference numeral 10 indicates the apparatus, as a whole, which is upright rectangular in general configuration. The apparatus comprises a head 12 mounted on and supported by a base 14 containing a circuit 16 connecting a source of electrical energy AC with the head. The head 12 is also generally rectangular and is characterized by a transverse arcuate upper end having a transverse generally U-shaped recess 18 formed therein with its inner limit defining a bight surface 20 formed on a radius complemental with the radius of a sucker stick 22. The sucker stick 22 has a jumbo size sucker 24 mounted on one end of the stick and contained by a wrapper or container 26 with the open or mouth end of the container 26 preferably wrapped or sealed in an angular twisted action, as at 28, about the periphery of the sucker stick.

The head 12 is preferably hollow and contains a resistance element 30 for heating the head in the manner presently described.

As mentioned hereinabove, the base 14 is preferably mounted on a platform 32 by suction cups 34 or obviously may be riveted or bolted thereto. A centrally drilled insulator 36 is interposed between the base 14 and the head for thermally insulating the head from the base. Two or more dowels 38 anchor the insulator to the head 12. The insulator 36 is in turn fastened to the top wall of the base, as by screws 40.

A pair of leads 42 and 44 are connected with a source of electrical energy AC and connected, respectively, with the armature 46 of a single-pole-double-through switch S and with one end of the resistance element 30. An extension of the wire 44, indicated at 44', is connected with one terminal 48 of the switch in series through a lamp L and a diode D. The other end of the heating element 30 is connected with the wire 44' between the lamp L and the diode D by a wire 50 also connected to the other switch terminal 52. The diode D maintains a lower temperature for the heating element and head 12 when the switch armature is made with its contact 48. The purpose of the lamp is to visually indicate when the apparatus is energized.

Operation

Operation seems obvious but briefly stated, the switch S is closed with one of its contacts for heating the head 12 to a selected greater than ambient temperature. The sucker 24 is inserted into the candy bag 26 and the bag wall, forming the open mouth thereof, is manually twisted in a selected direction around the periphery of the sucker stick 22 and, while holding the bag in this partial wrap-around position, the stick and folds of the bag open end are manually inserted laterally as a unit into the U-shaped slot 18 while angularly rotating the sucker, its container, stick and the container or bag folds at least one complete revolution of the stem. Simultaneously a selected pressure is applied to the stick to force it against the head wall forming the bight portion of the U-shaped socket. The temperature of the head surface being sufficient to heat seal the wrapper with the periphery of the sucker stick 22. This forms a sanitary and air tight seal for the sucker and its container.

Obviously the invention is susceptible to changes or alterations without defeating its practicability. Therefore, I do not wish to be confined to the preferred embodiment shown in the drawings and described herein.

I claim:

1. Apparatus for hermetically sealing the open mouth of a container of flexible material with the periphery of a confectionery supporting stem, comprising:

a stationary upright base;

an upstanding generally rectangular downwardly open hollow head having a relatively thick wall mounted on said base and having a transverse dimension less than the longitudinal dimension of a confectionery item support stem;

a generally rectangular thermal insulator interposed between said base and said head, said head having a transverse generally upwardly facing substantially U-shaped slot having a bight portion formed on a radius complemental with the radius of said stem; and, electrical resistance heating means within said head and connected by wiring with a source of electrical energy for heating and maintaining said heat at a selected temperature greater than ambient temperature, said insulator having a central opening cooperatively aligned with the hollow interior of said head for surrounding said wiring, whereby the surfaces defining the U-shaped slot heat seal the container open mouth with itself and the periphery of said confectionery stem when manually inserted thereinto and angularly rotated about the longitudinal axis of said stem.

* * * * *